US009269486B2

(12) United States Patent
Park et al.

(10) Patent No.: US 9,269,486 B2
(45) Date of Patent: Feb. 23, 2016

(54) POWER INDUCTOR AND METHOD OF MANUFACTURING THE SAME

(71) Applicant: SAMSUNG ELECTRO-MECHANICS CO., LTD., Suwon, Gyunggi-do (KR)

(72) Inventors: Moon Soo Park, Gyunggi-do (KR); Hwan Soo Lee, Gyunggi-do (KR); Hye Yeon Cha, Gyunggi-do (KR)

(73) Assignee: SAMSUNG ELECTRO-MECHANICS CO., LTD, Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/843,740

(22) Filed: Mar. 15, 2013

(65) Prior Publication Data

US 2014/0184374 A1 Jul. 3, 2014

(30) Foreign Application Priority Data

Dec. 28, 2012 (KR) ..... 10-2012-0155965

(51) Int. Cl.

| | |
|---|---|
| ***H01F 5/00*** | (2006.01) |
| ***H01F 27/24*** | (2006.01) |
| ***H01F 27/02*** | (2006.01) |
| ***H01F 27/255*** | (2006.01) |
| ***H01F 17/00*** | (2006.01) |
| ***H01F 41/04*** | (2006.01) |
| *H01F 17/04* | (2006.01) |

(52) U.S. Cl.

CPC ..... *H01F 27/255* (2013.01); *H01F 17/0013* (2013.01); *H01F 41/046* (2013.01); *H01F 2017/048* (2013.01); *Y10T 29/4902* (2015.01)

(58) Field of Classification Search

CPC ..... H01F 27/255; H01F 27/2804; H01F 17/0013; H01F 17/006; H01F 41/046; H01F 41/0246; H01F 41/041; H01F 2017/048; H01F 3/08; H01F 3/10

USPC ..... 336/200, 83, 233, 234, 232; 428/692.1

See application file for complete search history.

(56) References Cited

U.S. PATENT DOCUMENTS

| | | | | |
|---|---|---|---|---|
| 6,351,204 | B1 * | 2/2002 | Yamasawa et al. | 336/200 |
| 7,417,523 | B2 | 8/2008 | Waffenschmidt et al. | |
| 2007/0085647 | A1 | 4/2007 | Kawarai | |
| 2008/0199724 | A1 * | 8/2008 | Haga et al. | 428/688 |
| 2010/0052838 | A1 * | 3/2010 | Matsuta et al. | 336/200 |
| 2013/0033347 | A1 * | 2/2013 | Matsuura et al. | 336/83 |

FOREIGN PATENT DOCUMENTS

| | | | |
|---|---|---|---|
| KR | 10-2007-0032259 | A | 3/2007 |
| KR | 10-0737967 | B1 | 7/2007 |

* cited by examiner

*Primary Examiner* — Mangtin Lian

(74) *Attorney, Agent, or Firm* — McDermott Will & Emery LLP

(57) ABSTRACT

There is provided a power inductor, including a magnetic body including a substrate having coils formed thereon, a first metal-polymer complex layer formed on upper and lower surfaces of the substrate, and a second metal-polymer complex layer formed on upper and lower surfaces of the first metal-polymer complex layer and including a higher content of a polymer than that included in the first metal-polymer layer.

11 Claims, 5 Drawing Sheets

A–A'

A–A`

POWER INDUCTOR AND METHOD OF MANUFACTURING THE SAME

CROSS-REFERENCE TO RELATED APPLICATIONS

This application claims the priority of Korean Patent Application No. 10-2012-0155965 filed on Dec. 28, 2012, in the Korean Intellectual Property Office, the disclosure of which is incorporated herein by reference.

BACKGROUND OF THE INVENTION

1. Field of the Invention

The present invention relates to a power inductor having excellent inductance characteristics and improved reliability, and a method of manufacturing the same.

2. Description of the Related Art

Examples of electronic components using a ceramic material include a capacitor, an inductor, a piezoelectric element, a varistor, a thermistor, and the like.

Among these ceramic electronic components, an inductor, an important passive element configuring an electronic circuit, together with a resistor and a capacitor, may mainly be used as a component for removing noise or configuring an LC resonance circuit.

An inductor may be manufactured by winding coils around a ferrite core or printing a coil pattern on the ferrite core and forming electrodes at both ends thereof, or may be manufactured by printing internal electrodes on a magnetic material or a dielectric material and then stacking layers of the magnetic material or the dielectric material.

An inductor may be divided into one of several types thereof, such as a multilayered type inductor, a winding type inductor, a thin film type inductor, and the like, according to a structure thereof. Manufacturing methods of the respective inductors, in addition to ranges of application thereof, differ.

Among the types of inductors, the winding type inductor may be formed by winding coils around, for example, a ferrite core. However, in a case in which the number of windings is increased in order to obtain high inductance, stray capacitance between coils, that is, capacitance between conducting wires may be generated, such that high frequency characteristics are deteriorated.

In addition, a power inductor may be manufactured as a laminated body in which ceramic sheets formed of a plurality of ferrite or low-k dielectric materials are stacked.

Here, the ceramic sheets may have coil type metal patterns formed thereon. The coil type metal patterns formed on the respective ceramic sheets may be sequentially connected to each other by conductive vias formed in the respective ceramic sheets, and may form an overlapping structure in a vertical direction in which the ceramic sheets are stacked.

According to the related art, an inductor body configuring the power inductor has generally been formed of a quaternary ferrite material including nickel (Ni), zinc (Zn), copper (Cu) and iron (Fe).

However, this ferrite material has a saturation magnetization value lower than that of metal, such that high current characteristics required in a recent electronic product may not be able to be implemented therein.

Meanwhile, in the case in which the inductor body of the power inductor is formed of a metal component, the saturation magnetization value may be relatively increased as compared to the case in which the inductor body is formed of ferrite. However, in this case, eddy current loss and hysteresis loss may be increased at a high frequency, such that material loss may be intensified.

In order to reduce material loss, according to the related art, a structure in which metal powder particles are insulated from each other with a polymer resin has been used. However, in this case, a volume fraction of metal may be decreased when the content of the polymer resin is increased, such that an effect of increasing a saturation magnetization value by the use of the metal component, may not be sufficiently implemented.

Meanwhile, in the case in which the volume fraction of metal is increased, the content of the polymer resin is decreased. In this case, a high level of acidic or basic solution used in the manufacturing of an inductor permeates into a chip, which may cause a reduction in inductance characteristics.

RELATED ART DOCUMENT (Patent Document 1) Korean Patent Laid-Open Publication No. 2007-0032259

SUMMARY OF THE INVENTION

An aspect of the present invention provides a power inductor having excellent inductance and improved reliability, and a method of manufacturing the same.

According to an aspect of the present invention, there is provided a power inductor, including: a magnetic body including a substrate having coils formed thereon; a first metal-polymer complex layer formed on upper and lower surfaces of the substrate; and a second metal-polymer complex layer formed on upper and lower surfaces of the first metal-polymer complex layer and including a higher content of a polymer than that included in the first metal-polymer layer.

The first metal-polymer complex layer may include at least one metal selected from a group consisting of iron-nickel (Fe—Ni), iron-nickel-silicon (Fe—Ni—Si), iron-aluminum-silicon (Fe—Al—Si), and iron-aluminum-chrome (Fe—Al—Cr).

The second metal-polymer complex layer may include at least one metal selected from a group consisting of iron-nickel (Fe—Ni), iron-nickel-silicon (Fe—Ni—Si), iron-aluminum-silicon (Fe—Al—Si), and iron-aluminum-chrome (Fe—Al—Cr).

The first metal-polymer complex layer may include at least one polymer selected from a group consisting of epoxy, polyimide, and a liquid crystalline polymer (LCP).

The second metal-polymer complex layer may include at least one polymer selected from a group consisting of epoxy, polyimide, and a liquid crystalline polymer (LCP).

The first metal-polymer complex layer may include 2.0 to 5.0 parts by weight of the polymer based on 100 parts by weight of a metal.

The second metal-polymer complex layer may include 4.0 to 10.0 parts by weight of the polymer based on 100 parts by weight of a metal.

The power inductor may further include an insulating layer provided between the substrate and the first metal-polymer complex layer.

The insulating layer may include at least one material selected from a group consisting of epoxy, polyimide, and a liquid crystalline polymer (LCP).

Here, the first metal-polymer complex layer and the second metal-polymer complex layer may include metal particles having an average diameter of 1 to 50 μm.

Here, each of the first metal-polymer complex layer and the second metal-polymer complex layer may have a thickness corresponding to 5 to 30% of an overall thickness of the magnetic body.

According to another aspect of the present invention, there is provided a method of manufacturing a power inductor, the method including: preparing a substrate having coils formed thereon; preparing a plurality of first sheets including a metal powder and a polymer resin; preparing a plurality of second sheets including a metal powder and a polymer resin and having a higher content of a polymer than that of the first sheets; laminating the plurality of first sheets on upper and lower surfaces of the substrate such that the coils are buried; and laminating the second sheets on the first sheets, to thereby form a magnetic body.

The metal powder may be at least one selected from a group consisting of iron-nickel (Fe—Ni), iron-nickel-silicon (Fe—Ni—Si), iron-aluminum-silicon (Fe—Al—Si), and iron-aluminum-chrome (Fe—Al—Cr).

The polymer resin may be at least one selected from a group consisting of epoxy, polyimide, and a liquid crystalline polymer (LCP).

The first sheets may include 2.0 to 5.0 parts by weight of the polymer resin based on 100 parts by weight of the metal powder.

The second sheets may include 4.0 to 10.0 parts by weight of the polymer resin based on 100 parts by weight of the metal powder.

The method may further include, before the laminating of the plurality of first sheets on the upper and lower surfaces of the substrate, forming an insulating layer on the upper and lower surfaces of the substrate.

The insulating layer may include at least one material selected from a group consisting of epoxy, polyimide, and a liquid crystalline polymer (LCP).

Here, the metal powder may have an average particle diameter of 1 to 50 μm.

The method may further include, after the forming of the magnetic body, forming external electrodes on external surfaces of the magnetic body.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
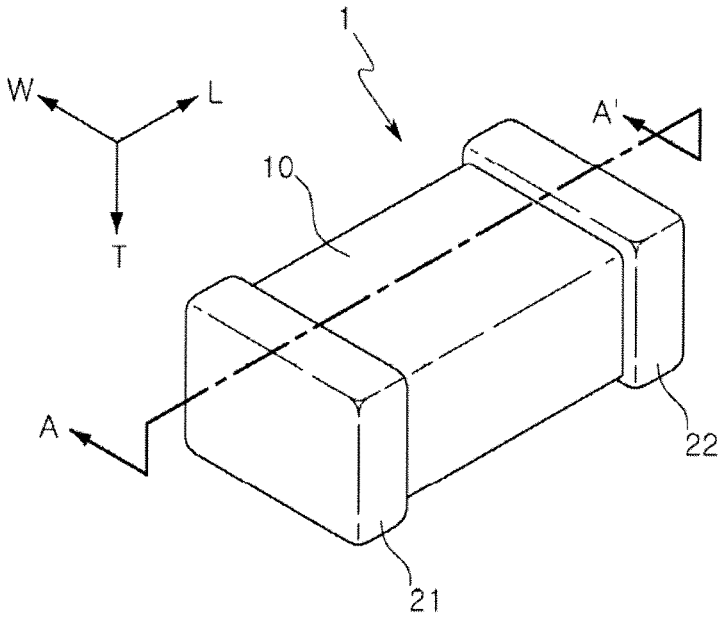
FIG. 1 is a perspective view showing a schematic structure of a power inductor according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

FIG. 1 is a perspective view showing a schematic structure of a power inductor according to an embodiment of the present invention.

Figure 2:
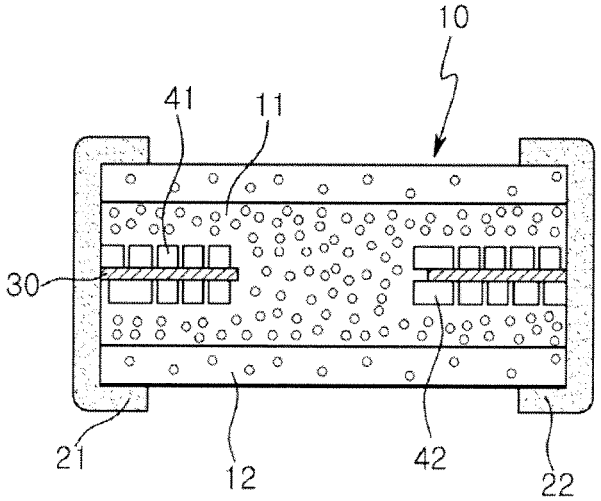
FIG. 2 is a cross-sectional view schematically showing the power inductor taken along line A-A' of FIG. 1.
Figure 5:
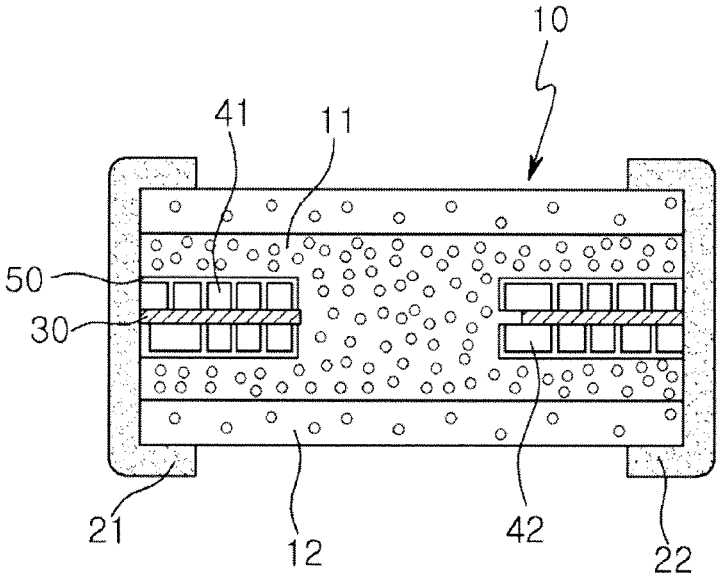
FIG. 5 is a cross-sectional view schematically showing the power inductor according to another embodiment of the present invention taken along line A-A' of FIG. 1.

FIG. 2 is a cross-sectional view schematically showing the power inductor according to one embodiment of the present invention taken along line A-A' of FIG. 1, while FIG. 5 is a cross-sectional view schematically showing the power inductor according to another embodiment of the present invention taken along line A-A' of FIG. 1.

Figure 3:
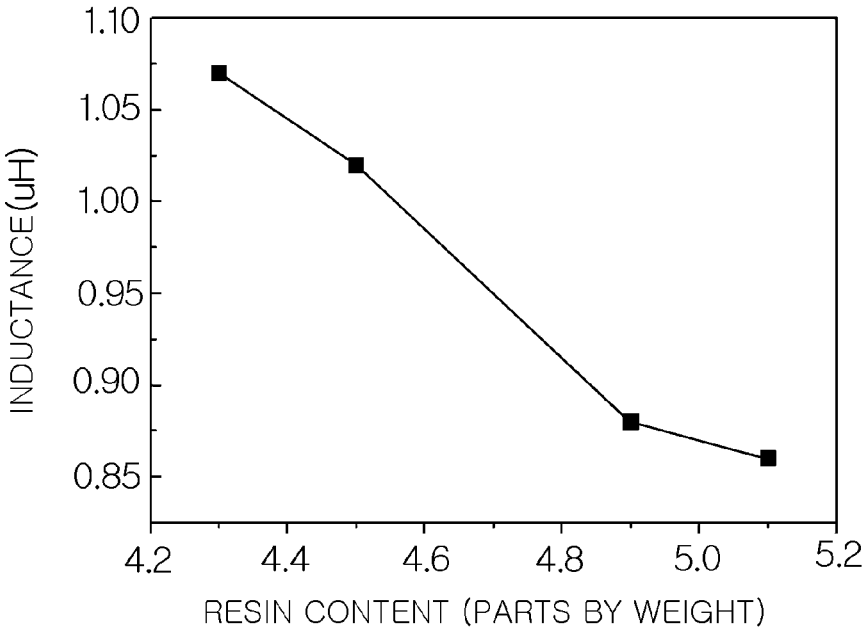
FIG. 3 is a graph showing changes in inductance according to the content of a polymer resin.
Figure 4A:
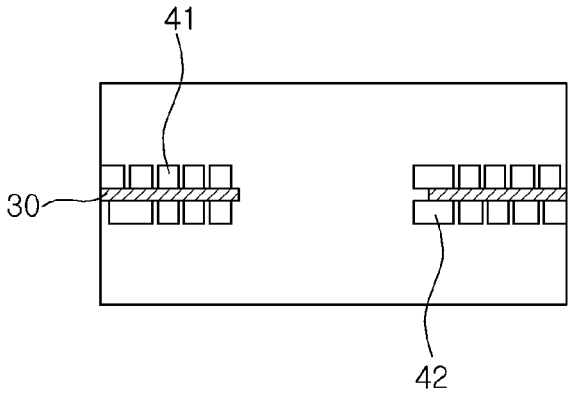
FIGS. 4A to 4D are views showing a process of manufacturing a power inductor according to an embodiment of the present invention.
Figure 4B:
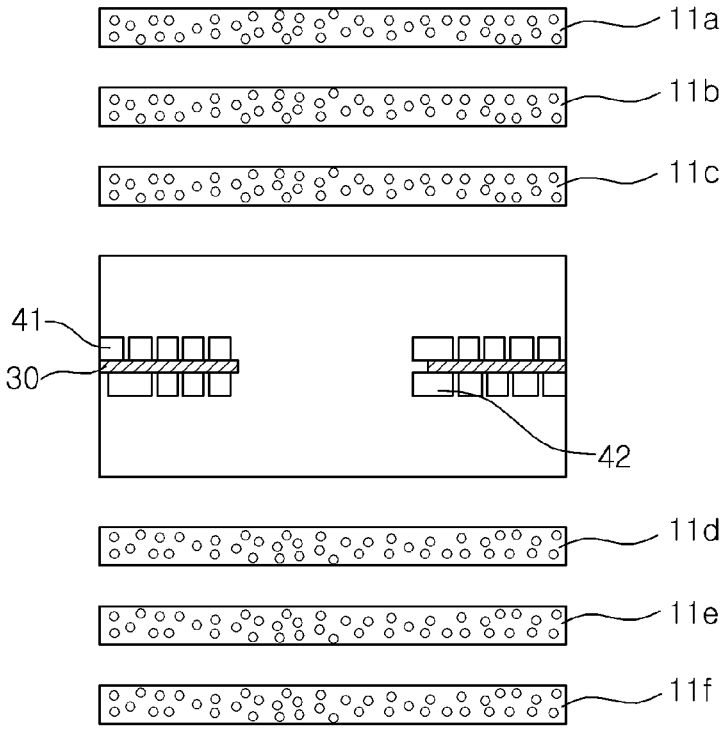
Figure 4C:
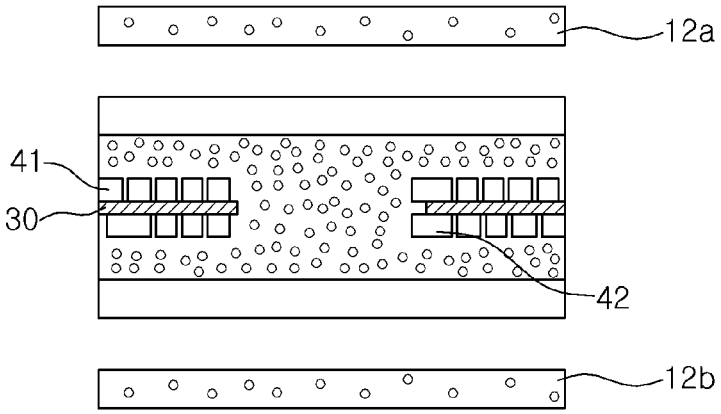
Figure 4D:
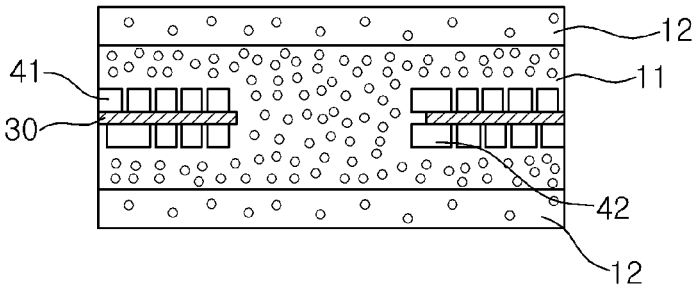

FIG. 3 is a graph showing the change in inductance as compared with the content of polymer resin.

Referring to FIGS. 1 to 3, a power inductor 1 according to an embodiment of the present invention may include: a magnetic body 10 including a substrate 30 having coils 41 and 42 formed thereon; a first metal-polymer complex layer 11 formed on upper and lower surfaces of the substrate 30; and a second metal-polymer complex layer 12 formed on upper and lower surfaces of the first metal-polymer complex layer 11 and including a higher content of a polymer than that included in the first metal-polymer layer 11.

The power inductor 1 according to the embodiment of the present invention may include the magnetic body 10 including the substrate 30 on which the coils 41 and 42 are formed.

The magnetic body 10 may have a hexahedral shape but is not limited thereto.

The magnetic body 10 may have the substrate 30 and the coils 41 and 42 formed on both surfaces of the substrate 30. The coils 41 and 42 may have one ends electrically connected to the first and second external electrodes 21 and 22, respectively.

The substrate 30 may be manufactured by using an insulating material such as photosensitive polymer, and a magnetic material such as ferrite, but is not particularly limited thereto.

A photosensitive insulating material may be formed between the coils 41 and 42, and the coils 41 and 42 may be electrically connected to each other through a conductive via (not shown).

The conductive via may be formed by a method, such as, forming a penetration hole (not shown) penetrating the substrate 30 in a thickness direction of the substrate 30 and then filling the penetration hole with a conductive paste.

The coils 41 and 42 may be formed by a thick film printing method, a paste applying method, a depositing method, a sputtering method, and the like. However, the present invention is not limited thereto.

In addition, a material for forming the coils 41 and 42 and the conductive paste for forming the conductive via may be at least one of silver (Ag), copper (Cu), and a copper alloy, but is not limited thereto.

In addition, the power inductor 1 according to the embodiment of the present invention may include the first and second external electrodes 21 and 22 formed on both end portions of the magnetic body 10.

The first and second external electrodes 21 and 22 may be formed on both end portions of the magnetic body 10 by various methods such as a method of immersing the magnetic body 10 in a conductive paste, a printing method, a depositing method, a sputtering method, and the like.

The first and second external electrodes 21 and 22 may include a metal for imparting electric conductivity thereto, for example, at least one selected from the group consisting of gold, silver, platinum, copper, nickel, palladium, and alloys thereof.

Here, as necessary, a nickel-plating layer (not shown) or a tin plating layer (not shown) may be further formed on surfaces of the first and second external electrodes 21 and 22.

The power inductor 1 according to the embodiment of the present invention may include the first metal-polymer complex layer 11 formed on the upper surface and the lower surface of the substrate 30.

The first metal-polymer complex layer 11 may include at least one metal selected from the group consisting of iron-nickel (Fe—Ni), iron-nickel-silicon (Fe—Ni—Si), iron-aluminum-silicon (Fe—Al—Si), and iron-aluminum-chrome (Fe—Al—Cr), but is not limited thereto.

In addition, the first metal-polymer complex layer 11 may include at least one polymer selected from the group consisting of epoxy, polyimide, and a liquid crystalline polymer (LCP), but is not limited thereto.

Meanwhile, the second metal-polymer complex layer 12 may be formed on the upper surface and the lower surface of the first metal-polymer complex layer 11 and include a higher content of a polymer than that included in the first metal-polymer complex layer 11.

The second gold-polymer complex layer 12 may include at least one metal selected from the group consisting of iron-nickel (Fe—Ni), iron-nickel-silicon (Fe—Ni—Si), iron-aluminum-silicon (Fe—Al—Si), and iron-aluminum-chrome (Fe—Al—Cr), but is not limited thereto.

In addition, the second metal-polymer complex layer 12 may include at least one polymer selected from the group consisting of epoxy, polyimide, and a liquid crystalline polymer (LCP), but is not limited thereto.

The metal included in the first metal-polymer complex layer 11 and the second metal-polymer complex layer 12 may be surface-coated with ferrite.

As the ferrite, at least one ferrite oxide selected from the group consisting of nickel ferrite (Ni Ferrite), zinc ferrite (Zn Ferrite), copper ferrite (Cu Ferrite), manganese ferrite (Mn Ferrite), cobalt ferrite (Co Ferrite), barium ferrite (Ba Ferrite), and nickel-zinc-copper ferrite (Ni—Zn—Cu Ferrite) and the like may be used, but the present invention is not limited thereto.

Generally, the power inductor was manufactured such that the coils are buried by pressurizing a composite magnetic material on the substrate having the coils formed thereon, and then performing molding and hardening thereon, and in the case, the composite magnetic material is formed by mixing a metal magnetic powder and a thermal-hardening resin in such a manner that a filling rate of the metal magnetic powder is 65 to 90 vol %.

In the above case, if the filling rate of metal magnetic powder is high, the final product has excellent inductance characteristics. On the other hand, the amount of the resin is decreased, an acidic or basic solution may permeate into a chip, resulting in deteriorating reliability and reducing inductance characteristics.

Whereas, if the content of the resin is high, the defect in which the acidic or basic solution permeates into the chip may be solved, but the filing ratio of metal magnetic powder may be decreased, resulting in deteriorating inductance characteristics of the product.

Therefore, according to the embodiment of the invention, the above defects may be solved by differing contents of resins of the first and second metal-polymer complex layers 11 and 12, which fill an inside of the magnetic body 10 such that the coils 41 and 42 are buried in the magnetic body 10.

Specifically, the first metal-polymer complex layer 11 formed on the upper surface and the lower surface of the substrate 30 may increase the filling ratio of the metal, thereby improving inductance characteristics of the final product.

In addition, the defect in which an acidic or basic solution permeates into the chip may be solved by forming the second metal-polymer complex layer 12 including a higher content of the polymer than that included in the first metal-polymer complex layer 11, on the upper surface and the lower surface of the first metal-polymer complex layer 11.

In the magnetic body 10, thicknesses of the first metal-polymer complex layer 11 and the second metal-polymer complex layer 12 are not particularly limited, and may be varied depending on inductance characteristics of products.

For example, each thickness of the first metal-polymer complex layer 11 and the second metal-complex layer 12 may be 5 to 30% based on the overall thickness of the magnetic body 10, and thus reliability of the power inductor 1 may be excellent and inductance characteristics thereof may be improved.

If each thickness of the first metal-polymer complex layer 11 and the second metal-polymer complex layer 12 may be below 5% based on the overall thickness of the magnetic body 10, the thickness of the second-polymer complex layer having a higher content of resin may be excessively small, and thus the acidic or basic solution may permeate into the chip.

Meanwhile, if each thickness of the first metal-polymer complex layer 11 and the second metal-polymer complex layer 12 may be above 30% based on the overall thickness of the magnetic body 10, the filling ratio of metal may be decreased, which causes defects in inductance characteristics of the final product.

According to the embodiment of the present invention, the first metal-polymer complex layer 11 may include 2.0 to 5.0 parts by weight of the polymer based on 100 parts by weight of the metal, but is not necessarily limited thereto.

In addition, the second metal-polymer complex layer 12 may include 4.0 to 10.0 parts by weight of the polymer based on 100 parts by weight of the metal, but is not limited thereto.

As described above, according to the embodiment of the present invention, improvements in inductance characteristics and reliability may be achieved by differentiating the content of the polymer included in the first metal-polymer complex layer 11 from the content of the polymer included in the second metal-polymer complex layer 12.

That is, the first metal-polymer complex layer 11 having a high filing ratio of metal is disposed at an inside of the magnetic body 10, adjacently to the substrate 30, and the second metal-polymer complex layer 12 having a high content of resin is disposed on the upper surface and the lower surface of the first metal-complex layer 11, thereby improving inductance characteristics and reliability.

According to the embodiment of the present invention, the first metal-polymer complex layer 11 and the second metal-polymer complex layer 12 may be formed by laminating a plurality of sheets.

However, the present invention is not limited thereto, and as necessary, various methods may be used, such as, a method of printing a paste formed of materials including a metal powder and a polymer so as to have a predetermine thickness, or a method of inserting paste into a frame and then performing compression thereon.

Here, the number of sheets laminated to form the magnetic body 10 or the thickness of the paste uniformly printed may be appropriately determined in consideration of required electric characteristics of the power inductor 1, such as inductance and the like.

The forming of the first metal-polymer complex layer 11 and the second metal-polymer complex layer 12 will be described below in detail.

FIG. 3 shows changes in inductance depending on the content of the resin, and it may be seen that, for example, if the content of the resin is above 5.0 parts by weight based on 100 parts by weight of the metal, inductance may be degraded.

Meanwhile, an average diameter of metal particles included in the first metal-polymer complex layer 11 and the second metal-polymer complex layer 12 may be 1 to 50 μm, but is not limited thereto.

In addition, the polymer included in the first metal-polymer complex layer 11 and the second metal-polymer complex layer 12 provides insulation characteristics between metal powder particles, and may be formed of a thermal-hardening resin.

The thermal-hardening resin may be at least one selected from a group consisting of a novolac epoxy resin, a phenoxy type epoxy resin, a BPA type epoxy resin, a BPF type epoxy resin, a hydrogenated BPA epoxy resin, a dimer acid modified epoxy resin, a urethane modified epoxy resin, a rubber modified epoxy resin, and a DCPD type epoxy resin.

Referring to FIG. 5, according to another embodiment of the present invention, the substrate 30 further includes an insulating layer 50 formed on circumferences of the coils 41 and 42. The insulating layer 50 may be further provided between the coils 41 and 42 and the first metal-polymer complex layer 11 to insulate from the coils 41 and 42 formed on the upper surface or the lower surface of the substrate 30 from the metal.

The insulating layer 50 may include at least one material selected from the group consisting of epoxy, polyimide, and a liquid crystalline polymer (LCP), but is not limited thereto.

Hereinafter, a method of manufacturing a power inductor according to an embodiment of the present invention will be described, but is not limited thereto.

FIGS. 4A to 4D are views showing a process of manufacturing a power inductor according to an embodiment of the present invention.

Referring to FIGS. 4A to 4D, a method of manufacturing a power inductor according to an embodiment of the present invention may include: preparing a substrate having coils formed thereon; preparing a plurality of first sheets including a metal powder and a polymer resin; preparing a plurality of second sheets including a metal powder and a polymer resin and having a higher content of a polymer than that of the first sheets; laminating the plurality of first sheets on upper and lower surfaces of the substrate such that the coils are buried; and laminating the second sheets on the first sheets, to thereby form a magnetic body.

First, a substrate formed of an insulating material or a magnetic material may be prepared.

Then, a substrate having coils formed thereon may be prepared by respectively forming coils 41 and 42 on both surfaces of the substrate 30.

The coils 41 and 42 may be sequentially provided such that a conductive paste is plated on one surface of the substrate 30 to form the first coil 41; a conductive via penetrating the substrate 30 is formed; and then the conductive paste is plated on the other surface of the substrate 30, opposite to the first coil 41, to form the second coil 42. The first and second coils 41 and 42 may be electrically connected to each other by the conductive via.

The conductive via may be provided by forming a penetration hole in the substrate 30 in the thickness direction of the substrate 30 using a laser, a punching device, or the like, and then filling the penetration hole with the conductive paste.

Here, the conductive paste may include at least one selected from the group consisting of gold, silver, platinum, copper, nickel, palladium, and alloys thereof, metals for imparting electric conductivity.

In addition, the first and second coils 41 and 42 and the conductive via may be formed of the same material in order to realize more stable electric conductivity.

Then, the foregoing substrate 30 having the first and second coils 41 and 42 formed thereon is disposed on a lower magnetic layer, that is, the second metal-polymer complex layer 12 composed of a magnetic material.

Here, a plurality of substrates 30 may be stacked in the thickness direction of the main body 10, and one ends of the first and second coil 41 or 42 of the substrates 30, which are adjacent to each other in a stacking direction of the substrates 30, may be electrically connected to each other through via conductors (not shown).

In addition, the insulating layer may be formed on circumferences of the first and second coils 41 and 42 by using a material such as a polymer having insulating properties, so as to surround the surfaces of the first and second coils 41 and 42.

Then, a plurality of first sheets 11*a*, 11*b*, 11*c*, 11*d*, 11*e*, and 11*f* each including a metal powder and a polymer resin may be prepared.

The plurality of first sheets 11*a*, 11*b*, 11*c*, 11*d*, 11*e*, and 11*f* constitute the first metal-polymer complex layer in the power inductor according to the embodiment of the present invention. Each of the first sheets may include 2.0 to 5.0 parts by weight of a polymer based on 100 parts by weight of a metal.

Then, a plurality of second sheets may be prepared, and here, the second sheets may include a metal powder and a polymer resin, and have a higher content of a polymer than that of the first sheets.

The plurality of second sheets 12*a* and 12*b* constitute the second metal-polymer complex layer in the power inductor according to the embodiment of the present invention. Each of the second sheets 12*a* and 12*b* may include 4.0 to 10.0 parts by weight of a polymer based on 100 parts by weight of a metal.

Then, the plurality of first sheets 11*a*, 11*b*, 11*c*, 11*d*, 11*e*, and 11*f* may be laminated on the upper surface and the lower surface of the substrate to thereby allow the coils to be buried, and the second sheets 12*a* and 12*b* may be laminated on the first sheets to thereby form the magnetic body.

Specifically, the first sheets 11*a*, 11*b*, 11*c*, 11*d*, 11*e*, and 11*f* are laminated to allow the coils to be buried and the second sheets 12*a* and 12*b* are laminated on the first sheets to be subjected to pressurizing and molding processes, and then the plurality of sheets are hardened, thereby completing the forming of the magnetic body.

According to another embodiment of the present invention, before the plurality of first sheets are laminated on the upper surface and the lower surface of the substrate, the insulating layer may be further formed on the upper surface and the lower surface of the substrate.

Then, the first and second external electrodes 21 and 22 may be formed the both end portions of the magnetic body 10 so as to be electrically connected to lead portions of the coils 41 and 42.

Here, the first and second external electrodes 21 and 22 may be formed by immersing the magnetic body 10 in a conductive paste, printing the conductive paste on the both end portion of the magnetic body 10, or using a depositing method, a sputtering method or the like.

The conductive paste may include a metal for imparting electric conductivity to the first and second external electrodes 21 and 22, for example, at least one selected from the group consisting of gold, silver, platinum, copper, nickel, palladium, and alloys thereof.

In addition, as necessary, a nickel-plating layer or a tin plating layer may be further formed on the surfaces of the first and second external electrodes 21 and 22.

As set forth above, according to the embodiment of the present invention, the magnetic body includes the first metal-polymer complex layer having a relatively small content of a polymer resin and the second metal-polymer complex layer having a relatively large content of the polymer resin, so that inductance characteristics can be improved.

Further, since the content of the polymer resin included in the second metal-polymer complex layer formed on edge portions of the magnetic body is relatively large, it is difficult for an acid or a base to permeate into the magnetic body from an external environment, such that an inductor having excellent reliability can be realized.

While the present invention has been shown and described in connection with the embodiments, it will be apparent to those skilled in the art that modifications and variations can be made without departing from the spirit and scope of the invention as defined by the appended claims.

What is claimed is:

1. A power inductor, comprising:

a magnetic body including a substrate having coils formed thereon;

a first metal-polymer complex layer formed on upper and lower surfaces of the substrate; and a second metal-polymer complex layer formed on upper and lower surfaces of the first metal-polymer complex layer and including a higher content of a polymer than that included in the first metal-polymer complex layer wherein the first metal-polymer complex layer includes 2.0 to 5.0 parts by weight of the polymer based on 100 parts by weight of a metal.

2. The power inductor of claim 1, wherein the first metal-polymer complex layer includes at least one metal selected from a group consisting of iron-nickel (Fe—Ni), iron-nickel-silicon (Fe—Ni—Si), iron-aluminum-silicon (Fe—Al—Si), and iron-aluminum-chrome (Fe—Al—Cr).

3. The power inductor of claim 1, wherein the second metal-polymer complex layer includes at least one metal selected from a group consisting of iron-nickel (Fe—Ni), iron-nickel-silicon (Fe—Ni—Si), iron-aluminum-silicon (Fe—Al—Si), and iron-aluminum-chrome (Fe—Al—Cr).

4. The power inductor of claim 1, wherein the first metal-polymer complex layer includes at least one polymer selected from a group consisting of epoxy, polyimide, and a liquid crystalline polymer (LCP).

5. The power inductor of claim 1, wherein the second metal-polymer complex layer includes at least one polymer selected from a group consisting of epoxy, polyimide, and a liquid crystalline polymer (LCP).

6. The power inductor of claim 1, wherein the second metal-polymer complex layer includes 4.0 to 10.0 parts by weight of the polymer based on 100 parts by weight of a metal.

7. The power inductor of claim 1, wherein the substrate further includes an insulating layer formed on circumferences of the coils.

8. The power inductor of claim 7, wherein the insulating layer includes at least one material selected from a group consisting of epoxy, polyimide, and a liquid crystalline polymer (LCP).

9. The power inductor of claim 1, wherein the first metal-polymer complex layer and the second metal-polymer complex layer include metal particles having an average diameter of 1 to 50 μm.

10. The power inductor of claim 1, wherein each of the first metal-polymer complex layer and the second metal-polymer complex layer has a thickness corresponding to 5 to 30% of an overall thickness of the magnetic body.

11. A power inductor, comprising:

a magnetic body including a substrate having coils formed thereon;

a first metal-polymer complex layer formed on upper and lower surfaces of the substrate;

a second metal-polymer complex layer formed on upper and lower surfaces of the first metal-polymer complex layer;

wherein the first metal-polymer complex layer includes metal and a polymer;

the second metal-polymer complex layer includes metal and a polymer; and a content of the polymer in the second metal-polymer complex layer is higher than a content of the polymer in the first metal-polymer complex layer wherein the second metal-polymer complex layer includes 4.0 to 10.0 parts by weight of the polymer based on 100 parts by weight of a metal.

* * * * *